US006263694B1

(12) United States Patent
Boyko

(10) Patent No.: US 6,263,694 B1
(45) Date of Patent: Jul. 24, 2001

(54) COMPRESSOR PROTECTION DEVICE FOR REFRIGERATION SYSTEMS

(76) Inventor: James G. Boyko, 27 Church St., Gorham, ME (US) 04038

( * ) Notice: Subject to any disclaimer, the term of this patent is extended or adjusted under 35 U.S.C. 154(b) by 0 days.

(21) Appl. No.: 09/552,908

(22) Filed: Apr. 20, 2000

(51) Int. Cl.[7] ..... F25B 43/02; F25B 43/04

(52) U.S. Cl. ..... 62/468; 62/195

(58) Field of Search ..... 62/115, 120, 123, 62/169, 171, 173, 174, 176.1, 195, 468, 470; 34/75, 92, 402; 159/22; 417/151

(56) References Cited

U.S. PATENT DOCUMENTS

| | | | | |
|---|---|---|---|---|
| 3,636,723 | * | 1/1972 | Kramer | 62/197 |
| 3,792,594 | * | 2/1974 | Kramer | 62/503 |
| 4,068,493 | | 1/1978 | Micai . | |
| 4,210,001 | * | 7/1980 | Miller, Sr. | 62/468 |
| 4,530,215 | | 7/1985 | Kramer . | |
| 4,554,795 | | 11/1985 | Ibrahim . | |
| 5,076,067 | * | 12/1991 | Prenger et al. | 62/197 |
| 5,150,580 | * | 9/1992 | Hyde | 62/86 |
| 5,232,588 | * | 8/1993 | Gryder | 210/168 |
| 5,590,539 | * | 1/1997 | Marohl et al. | 62/84 |
| 5,664,425 | * | 9/1997 | Hyde | 62/90 |
| 5,694,780 | * | 12/1997 | Alsenz | 62/117 |
| 5,901,559 | | 5/1999 | Westermeyer . | |
| 6,185,944 | * | 2/2001 | Gaul | 62/115 |

OTHER PUBLICATIONS

Ashrae Handbook, Refrigeration–1998, pp. 1.7, 1.8, 1.9, 2.19, 2.20, 2.26, 3.5.

Parker, Refrigeration Specialties Division, Bulletin 61–10F, "Refrigeration Float Switch Type LL".

* cited by examiner

*Primary Examiner*—Teresa Walberg
*Assistant Examiner*—Daniel Robinson

(57) ABSTRACT

A device is added to a refrigeration system to protect the compressor from liquid slugging. The device traps liquid slugs in the suction pipe and then injects the trapped slugs into the discharge pipe. Any refrigerant within the injected slug is quickly vaporized and travels with the discharge gas to again accomplish useful cooling. Any oil within the injected slug travels with the discharge gas to the oil separator, where it is extracted from the discharge gas and then properly returned to the compressor to again provide lubrication.

8 Claims, 2 Drawing Sheets

*Step One–Low liquid level inside float switch 23*

*Step Two–High liquid level inside float switch 23*

COMPRESSOR PROTECTION DEVICE FOR REFRIGERATION SYSTEMS

BACKGROUND

1. Field of the Invention

This invention relates to the field of devices that protect refrigeration compressors from damage due to liquid slugging.

2. Description of Prior Art

For typical refrigeration systems, lubricating oil and liquid refrigerant can sporadically enter the suction piping connected to the compressors. This event is commonly called slugging, or sometimes called flood-back. Refrigeration compressors are specifically designed to pump only vapor and can be catastrophically damaged if they are forced to pump liquids. Therefore, methods have been developed to capture any liquid in the suction piping and thus reduce the likelihood that compressor damage will occur due to slugging.

The oil that can form slugs in the suction piping originates in the refrigeration compressors. This oil is normally held within the compressor crankcase and is thus constantly available to lubricate the compressor bearings and sliding parts.

During normal operation, some oil leaves the compressor with the discharge vapor as a mist and enters the refrigeration piping system. Methods and devices have been designed to collect most this oil leaving a compressor and properly returning this oil to the compressor crankcase. The most common method incorporates a device called an oil separator. Although many types of oil separators have been develop, they all strive to trap the oil mist and coalesce it back into a liquid. The captured oil is then directed to a reservoir, where it is stored until required to replenish the compressor crankcases.

A specialized device, called an oil float valve, controls the flow of oil from the oil reservoir to the compressor crankcase. The float valve senses the oil level within the crankcase. When a low oil level is sensed, the float valve allows oil to flow from the reservoir to the crankcase. Conversely, when a high oil level is sensed, the float valve prevents oil from flowing from the reservoir to the crankcase.

Oil separators and oil float valves have been proven highly reliable and therefore are widely used by the refrigeration industry. As an example of a modern oil float valve design, U.S. Pat. No. 5,901,559 discloses an electromechanical concept that is claimed to provide very stable performance.

The most common cause of liquid refrigerant in the suction piping is unstable expansion valve operation. The purpose of the expansion valve is to maintain the suction gas in a slightly superheated state, thereby striving to keep the suction piping free of liquid refrigerant. Even when properly sized, expansion valves sometimes become unstable and allow liquid refrigerant to enter the suction piping.

Since oil separators are not 100% efficient and expansion valves are not 100% reliable, the potential for liquid slugging exists even for well-designed refrigeration systems. A commonly used method of reducing the likelihood of compressor damage due to this inadvertent liquid slugging is to install a device in the suction piping that will trap the liquid before it reaches the compressors. This device is commonly called a suction trap, surge drum, knockout drum, or suction accumulator. The suction trap is a vessel that is substantially larger in volume than the suction piping. The velocity of the suction gas is thus reduced when it enters this large vessel, thereby promoting the entrained liquids to separate from the gas and settle to the bottom of the vessel.

The liquid that settles to the bottom of the suction trap can be either liquid refrigerant or oil, both of which must be reintroduce into the refrigeration system. Typically, these liquids are reintroduced back into the refrigeration system by slowly allowing these liquids to flow, or "bleed", into the suction piping located downstream of the suction trap. This "bleed" rate is usually controlled by a small valve or orifice. The valve or orifice is sized to produce a flow that hopefully is slow enough not to cause damage to the compressors.

ASHRAE Handbook, Refrigeration-1998, Chapter 2: "System Practices for Halocarbon Refrigerants", FIG. 17 and FIG. 34 provide some guidelines for designing suction traps. The metered liquid from the suction trap is heated, either with an electric heater or with a heat exchanger using the warm liquid refrigerant from the condenser. In this manner, refrigerant in the metered stream has a chance to be boil from a liquid to a gas before it is reintroduced into the refrigeration system. To further guard against the presence of refrigerant within the metered liquid, U.S. Pat. No. 4,068,493 describes the implementation of a thermostatic expansion valve, with its sensing bulb attached to the pipe carrying the metered liquid. In this manner, the thermostatic expansion valve stops the metered flow if it detects the presence of refrigerant, as indicated by a low superheat measurement.

ASHRAE Handbook, Refrigeration-1998, Chapter 2: "System Practices for Halocarbon Refrigerants", FIG. 17 also teaches that to achieve additional protection against compressor damage, the liquid from the suction trap can be stored in a receiver, commonly called a reservoir. The stored liquid is heated with an electric heater and then reintroduced into the compressor crankcases through float valves connected to each compressor crankcase. Since the reservoir and crankcase are essentially at the same pressure, the reservoir must be elevated above the crankcases to allow the oil to drain from the reservoir. Since it is sometimes inconvenient to substantially elevate the reservoir above the crankcases, U.S. Pat. No. 4,530,215 describes the use of a mechanical pump to force the oil from the reservoir to the crankcases.

ASHRAE Handbook, Refrigeration-1998, Chapter 2: "System Practices for Halocarbon Refrigerants", section titled PIPING AT MULTIPLE COMPRESSOR: Suction Piping also suggests that a suction trap can be constructed from the pipe that interconnects multiple compressors. This interconnecting piping is called the suction header. The ASHRAE Handbook states, "the suction header may be designed to function as a suction trap. The suction header should be large enough to provide a region of low velocity within the header to allow the suction gas and oil to separate". As an example of this concept, U.S. Pat. No. 4,554,795 discloses the use of the suction header as a suction trap, with the implementation of oil pick-up devices on each compressor suction line, which promote the oil to flow to the compressors that are running.

Another method of dealing with the liquid inside the suction trap for ammonia systems is described in ASHRAE Handbook, Refrigeration-1998, Chapter 3: "System Practices for Ammonia Refrigerants, FIG. 6 and FIG. 7. These illustrations show the transferring of the liquid refrigerant and oil from the low-pressure suction trap to the high-pressure liquid refrigerant receiver. This method uses a vessel called a transfer drum that can be alternately vented to either the low-pressure or the high pressure via solenoid valves. First, the transfer drum is vented to the low-pressure and allowed to fill up with the liquid from the suction trap. When the transfer drum is filled, a float switch is activated and then the vent is switched to the high pressure. Then the liquid refrigerant is drained from the transfer drum to the liquid refrigerant receiver, either with a pump or via gravity. After the transfer drum is empty, the float switch is deactivated and the vent is switched back to low-pressure and the cycle is repeated. Since oil and ammonia are nearly immiscible, the oil that is transferred from the suction trap to the receiver settles to the bottom of the receiver and is periodically drained. This method is not suitable for halocarbon systems because oil and halocarbon refrigerants are miscible. Therefore, there is no means to extract the oil from the refrigerant and then return it to the compressors.

In summary, the conventional methods for abating compressor damage due to liquid slugging are well documented and widely used today. Nevertheless, these methods suffer from several disadvantages:

(a) The method of metering the liquid from the suction trap back into the suction pipe is only effective for average slugging situations. But sometimes, system malfunctions can cause a large amount of liquid refrigerant or oil to travel through the suction pipe, resulting in a steady and persistent bleed flow. Under this situation, the conventional methods of heating the bleed flow to boil the liquid refrigerant into a vapor may be insufficient. A preferred method would be to use a device that would ensure sufficient heat to boil the entire liquid refrigerant in the bleed flow, for even the most severe flood-back conditions. Also preferred would be a heating method that does not require expensive electric heat or require the use of a heat exchanger.

(b) The method of feeding oil through float valves from a low-pressure storage reservoir to the compressor crankcases can be cumbersome to install because the reservoir must be substantially elevated above the compressors to cause the oil to properly flow. A preferred method would be to maintain the oil storage reservoir at a pressure higher than the crankcase pressure. In this manner, a reliable oil flow through the float valves will be assured, even if the receiver is not elevated above the compressors.

(c) The method of transferring the liquid from the suction trap to the liquid refrigerant receiver is not suitable for halocarbon systems because the oil and liquid refrigerant are miscible and therefore the oil cannot be extracted from the refrigerant and properly returned to the compressor crankcases. It would be preferred to implement a method where the oil can be readily extracted from the refrigerant and then reliably returned to the compressor crankcases.

What is needed, therefore, is a device to prevent compressor damage due to liquid slugging that can handle the most severe flood-back situations. What is further needed is a device to prevent compressor damage due to liquid slugging that does not require an electric heater or a heat exchanger to boil off the liquid refrigerant within the slug. What is yet further needed is device to prevent compressor damage due to liquid slugging that can return the oil within the slug back to the compressor crankcases in a highly reliable and easily implemented manner.

OBJECTS AND ADVANTAGES OF THE INVENTION

It is an object of the present invention to protect refrigeration compressors from the most severe and prolonged liquid slugging conditions. It is further an object of present invention to protect refrigeration compressors from liquid slugging without the use of expensive heat exchangers or the use of electric heaters. It is yet further an object of the present invention to return the oil within the slug to the compressor crankcases in a manner that is reliable and easily implemented.

In order to achieve these objects, the present invention provides a mean for injecting the slug collected from the suction trap directly into the compressor discharge pipe, prior to the oil separator. The injected slug is readily warmed by the highly superheated vapor traveling within the discharge pipe and therefore any liquid refrigerant within the injected slug is quickly boiled into a vapor. Since the injected slug is in direct contact with the superheated discharge gas, this heat transfer process occurs without the use of a heat exchanger or electric heater. After the liquid refrigerant is vaporized from the slug, any remaining oil is entrained in the discharge stream and travels to the oil separator. Therefore, by injecting the slug from the suction trap into the discharge pipe upstream of the oil separator, the oil separator removes most of the oil from the discharge stream and then the oil is reliably returned to the compressor crankcases.

During the development of this invention, detailed thermodynamic calculations have been performed to determine how much heat is available within the superheated discharge stream for converting the refrigerant within the injected slug from a liquid to a vapor. These calculations have indicated that for a typical refrigeration system, the maximum amount of injected liquid refrigerant is approximately 20% of the total refrigerant flow through the system. In other words, if the normal mass flow in the suction pipe is 10 lb/minute, then the present invention could protect the compressors from slugging with a steady flood-back as high as 2 lb/min of liquid refrigerant in the suction piping. A steady flood-back of 20% of the total refrigerant flow would be very unusual. Therefore, the present invention is deemed to provide reliable protection against slugging, even for the most severe flood-back situations.

Also during the development of this invention, it has been verified that heat transfer between the superheated discharge flow and the injected slug occurs very quickly, presumably because of the direct contact between these two flow streams. Through experimentation, it has been determined that the distance of approximately 20 pipe diameters is required to fully vaporize the liquid refrigerant within the injected slug. That is, if the discharge pipe size is 1" in diameter, then full vaporization of the refrigerant is assured after the injected slug travels approximately 20" of pipe length.

In conclusion, the present invention accomplishes three important tasks. First, the present invention removes any liquid slugs from the suction piping, even for very heavy and persistence flood-back situations. Second, the present invention vaporizes the refrigerant within the slug, without the use of a heat exchanger or an electric heater. Third, the present invention reintroduces the refrigerant back into the refrigeration system to accomplish useful cooling and directs the oil to the oil separator, where it is efficiently collected and then redirected back to the compressors in a reliable manner.

Reference Numerals in Drawings

Figure 1:
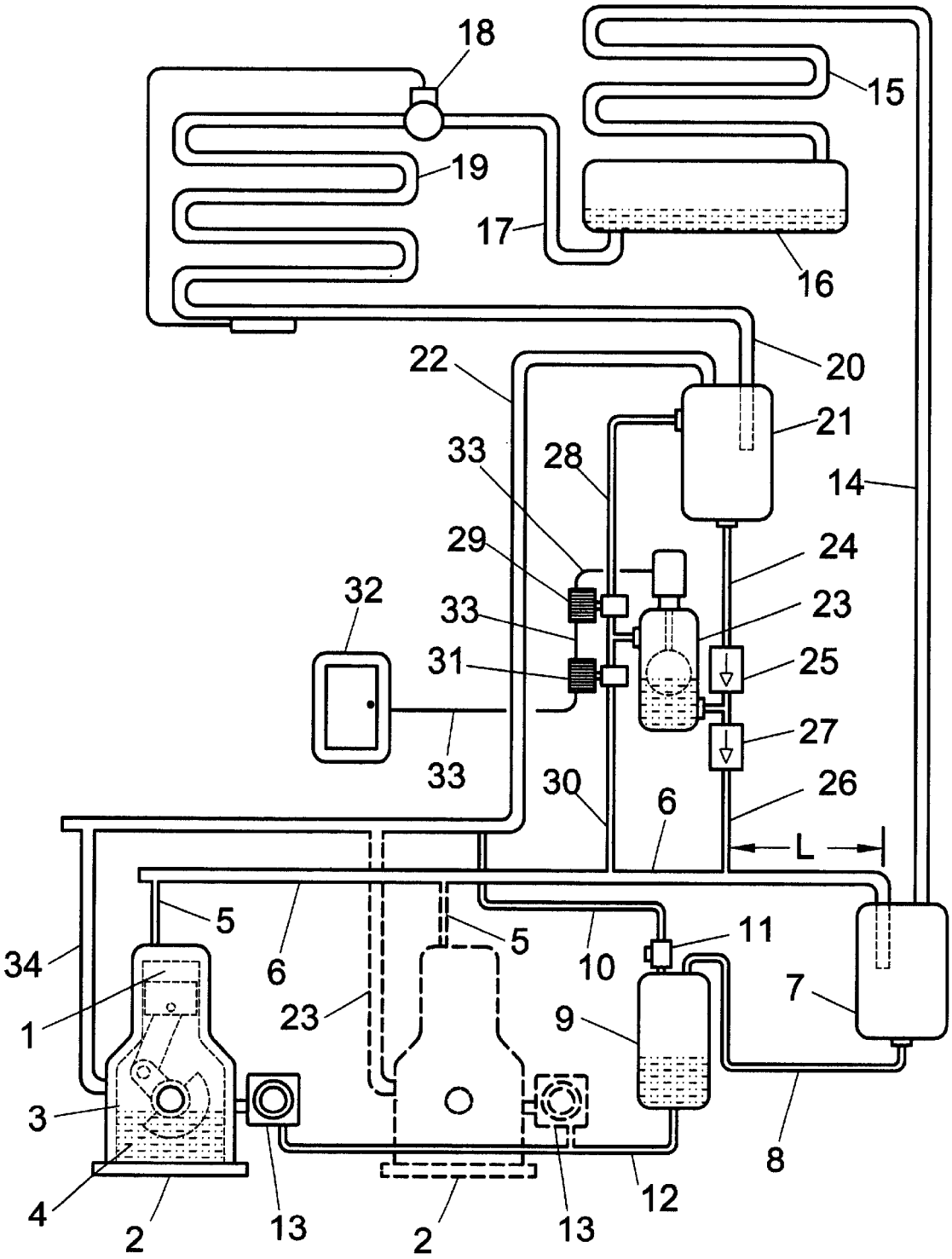
FIG. 1 is a schematic drawing of the preferred embodiment of the present invention, an embodiment in which the present invention is applied to a conventional refrigeration system.
Figure 2:
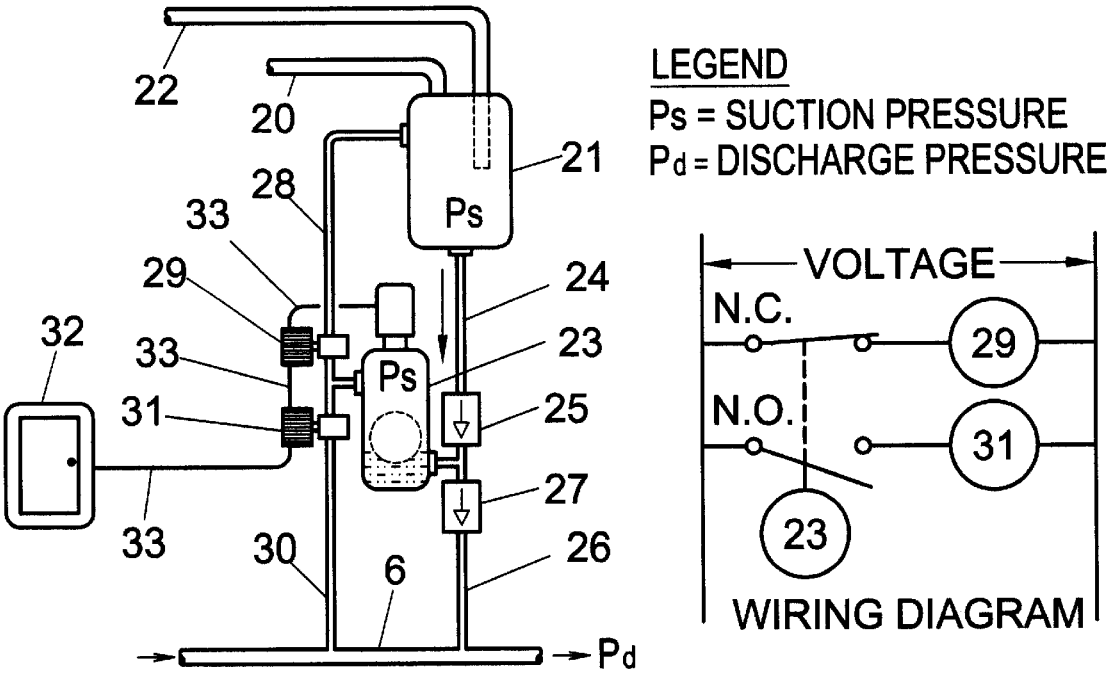
FIG. 2 is a sequence-of-operations diagram of the preferred embodiment of the present invention.
Figure 2:
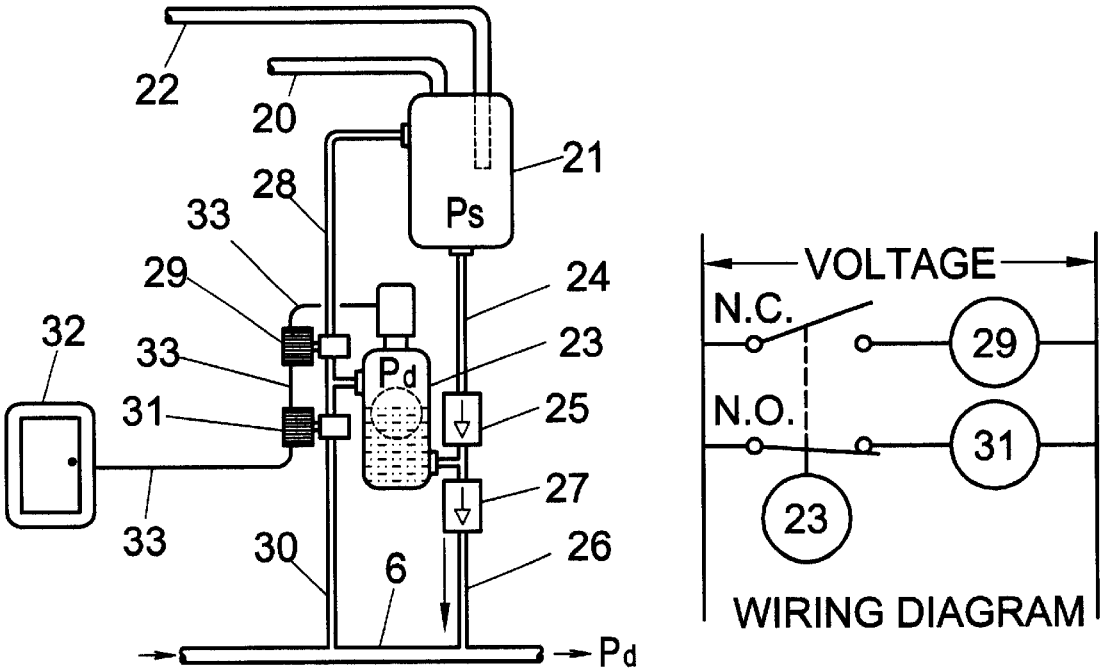

1 Refrigerant
2 Compressor
3 Compressor crankcase
4 Compressor oil
5 Compressor discharge pipe
6 Discharge pipe, from compressor discharge pipe 5 to oil separator 7
7 Oil separator
8 Oil pipe, from oil separator 7 to oil reservoir 9
9 Oil reservoir
10 Pipe, from suction pipe 22 to pressure regulator 11
11 Pressure regulator for oil reservoir 9
12 Oil pipe, from oil reservoir 9 to oil float valve 13
13 Oil float valve for compressor crankcase 3
14 Discharge pipe, from oil separator 7 to condenser 15
15 Condenser
16 Receiver
17 Liquid pipe, from receiver 16 to expansion valve 18
18 Expansion valve
19 Evaporator
20 Suction pipe, from evaporator 19 to suction trap 21
21 Suction trap
22 Suction pipe, from suction trap 21 to compressor suction pipe 34
23 Float switch
24 Drainpipe, from suction trap 21 to check valve 25
25 Check valve
26 Drainpipe, from check valve 27 to discharge pipe 6
27 Check valve
28 Vent pipe, from suction trap 21 to solenoid valve 29
29 Solenoid valve
30 Vent pipe, from discharge pipe 6 to solenoid valve 31
31 Solenoid valve
32 Power supply
33 Electrical wire
34 Compressor suction pipe

DETAILED DESCRIPTION OF THE INVENTION

The objectives and advantages of the present invention are achieved by applying it to a typical refrigeration system. This typical refrigeration system, with the implementation of the present invention, is illustrated by FIG. 1 and described as follows.

FIG. 1 shows a compressor 2 having a crankcase 3, a discharge pipe 5 and a suction pipe 34. Oil 4 is contained within crankcase 3 for lubricating the compressor bearings and cylinder walls. Crankcase 3 is vented to suction pipe 34. Thus, the pressure within crankcase 3 is nominally equal to the suction pressure, $P_s$.

FIG. 1 also shows an additional compressor 2, to illustrate that a multitude of compressors can be utilized in parallel fashion, by connecting the compressor suction pipes 34 to a common suction pipe 22 and likewise connecting the compressor discharge pipes 5 to a common discharge pipe 6.

The purpose of compressor 2 is to raise the pressure of the refrigerant 1 from a low pressure, typically called the suction pressure and expressed by symbol $P_s$, to a substantially higher pressure, typically called the discharge pressure and expressed by symbol $P_d$. To accomplish this task, compressor 2 pulls refrigerant 1 from suction pipe 22 and discharges refrigerant 1 into discharge pipe 6. Refrigerant 1 within discharge pipe 6 is in a superheated vapor state. That is, the temperature of refrigerant 1 is substantially above the saturation temperature corresponding to the discharge pressure.

As compressor 2 operates, a small portion of oil 4 is entrained within refrigerant 1 and thus travels with refrigerant 1 through discharge pipe 6. Oil separator 7 is installed in discharge pipe 6 to capture the entrained oil 4 traveling within discharge pipe 6. The captured oil 4 is first routed through oil pipe 8 to oil reservoir 9 for storage. From oil reservoir 9, the captured oil 4 is routed through oil pipe 12 to oil float valve 13 that allows oil 4 to flow into crankcase 3 upon sensing a low oil level. In order to assure adequate oil flow through oil float valve 13, the pressure within oil reservoir 9 is maintained at a steady value somewhat higher than the pressure within the crankcase, by venting oil reservoir 9 to suction pipe 22 using pressure regulator 11. In this fashion, pressure regulator 11 maintains a steady pressure difference between oil reservoir 9 and compressor crankcase 3.

It is noted that a typical oil separator 7 will not capture all of entrained oil 4 traveling within discharge pipe 6. Therefore, some oil continues to travel with refrigerant 1 and moves through discharge pipe 14 to condenser 15.

Condenser 15 cools refrigerant 1 to its saturation temperature, thus converting refrigerant 1 from a vapor to a liquid. After cooling to a liquid, refrigerant 1 and entrained oil 4 are stored within the receiver 16.

From receiver 16, refrigerant 1 and entrained oil 4 travel through liquid pipe 17 to expansion valve 18. The purpose of expansion valve 18 is to reduce the pressure of refrigerant 1 from the discharge pressure $P_d$ to the suction pressure $P_s$, thus promoting refrigerant 1 to boil from a liquid to a vapor within evaporator 19 and extract heat from the environment. Another objective of expansion valve 18 is to maintain refrigerant 1 in a slightly superheated state as it exits evaporator 19, thus promoting fully vaporization of refrigerant 1.

Under normal operation, refrigerant 1 within suction pipe 20 is fully vaporized and the entrained oil 4 within suction pipe 20 is in the form of a fine mist, and therefore can be safely returned to compressor 2. Nevertheless, unstable operation of expansion valve 18 can cause some refrigerant 1 within suction pipe 20 to be in a liquid state and thus travel as a liquid slug. Also, if the velocity with suction pipe 20 is low, the entrained oil 4 within suction pipe 20 can coalesce and thus cause the oil to travel as slugs in lieu of a fine mist. The liquid refrigerant or oil slugs can cause damage to compressor 2, which is designed specifically to pump only vapor.

The present invention is now applied to collect any slugs within suction pipe 20. In the preferred embodiment, this collection of slugs is accomplished by attaching suction trap 21 to suction pipe 20. Suction trap 21 is a large vessel that allows the velocity of refrigerant 1 to be substantially reduced. Due to this velocity reduction, liquids settle to the bottom of suction trap 21. Then, refrigerant 1, as a vapor, exits suction trap 21 through suction pipe 22 and continues to travel to compressor 2. Suction traps are widely used and design guidelines for suction traps are well documented. For example, ASHRAE Handbook, Refrigeration-1998, Chapter 1: "Liquid Overfeed Systems", FIG. 9 provides detailed parameters for designing suction traps.

The present invention now provides a means to inject the slugs collected by suction trap 21 into discharge pipe 6. In the preferred embodiment, this transference of liquid is accomplished by using gravity to drain the liquid from suction trap 21 to discharge pipe 6.

Float switch 23 is located sufficiently below suction trap 21 to allow gravity-drainage from suction trap 21 to float switch 23. Float switch 23 is a pressure vessel that provides a double-throw electrical switch that opens and closes in response to a change in liquid level. When the liquid level in float switch 23 is low, the normally-closed contact of the double-throw switch is closed and the normally-open contact of the double-throw switch is open. When the liquid level in float switch 23 is high, the normally-closed contact of the double-throw switch is open and the normally-open contact of the double-throw switch is closed. For float switch 23, the inventor has utilized an off-the-shelf part, specifically Refrigerant Float Switch Type LL, sold by Refrigerating Specialties, 2445 South 25$^{th}$ Avenue, Broadview, Ill. 60155-3858. For this particular float switch, a level change of approximately 2 inches is required to throw the double-throw electrical switch.

Drainpipe 24 is provided for draining liquid from suction trap 21 to float switch 23. One end of drainpipe 24 is connected to the bottom of suction trap 21. The other end of drainpipe 24 is connected to check valve 25, which is connect to float switch 23. Check valve 25 is installed to allow flowage from suction trap 21 to float switch 23 and stop flowage in the opposite direction.

In addition, drainpipe 26 is provided for draining liquid from float switch 23 to a portion of discharge pipe 6 that is located sufficiently below float switch 23 to allow gravity-drainage. One end of drainpipe 26 is connected to discharge pipe 6. The other end of drainpipe 26 is connected to check valve 27, which is connected to the lower portion of float switch 23. Check valve 27 is installed to allow flowage from float switch 23 to discharge pipe 6 and stop flowage in the opposite direction.

To facilitate drainage from suction trap 21 to float switch 23, vent pipe 28 is provided for equalizing the pressure between suction trap 21 and float switch 23. One end of vent pipe 28 is connected to the upper portion of suction trap 21. The other end of vent pipe 28 is connected to normally-closed solenoid valve 29, which is connected to the upper portion of float switch 23. Solenoid valve 29 is wired in series with the normally-closed contact within float switch 23 and power supply 32, using wire 33. In this manner, when the liquid level inside float switch 23 is low, the normally-closed contact within float switch 23 is closed and solenoid valve 29 is energized. Solenoid valve 29 is thus opened which assures that the pressure within float switch 23 is the same as the pressure within the suction trap 21.

In addition, to facilitate drainage from float switch 23 to discharge pipe 6, vent pipe 30 is provided for equalizing the pressure between float switch 23 and discharge pipe 6. One end of vent pipe 30 is connected to discharge pipe 6.

The other end of vent pipe 30 is connected to normally-closed solenoid valve 31, which is connected to the upper portion of float switch 23. Solenoid valve 30 is wired in series with the normally-open contact within float switch 23 and power supply 32, using wire 33. In this manner, when the liquid level inside float switch 23 is high, the normally-open contact within float switch 23 is closed and solenoid valve 31 is energized. Solenoid valve 31 is thus opened which assures that the pressure within float switch 23 is the same as the pressure within discharge pipe 6.

It is now noted that the pressure inside suction trap 21, $P_s$, is lower than the pressure inside discharge pipe 6, $P_d$. Therefore, in order to transfer liquid from suction trap 21 to discharge pipe 6, the preferred embodiment of the present invention utilizes a two-step process. This two-step process is illustrated by the sequence-of-operations diagram provided by FIG. (2).

Now, referring to FIG. (2), the two-step process is explained as follows:

Step One—Low liquid level inside float switch 23

As illustrated by the electrical wiring diagram, the normally-closed electrical contact within float switch 23 is now closed, which energizes and thus opens normally-closed solenoid valve 29. With solenoid valve 29 open, the pressure between float switch 23 and suction trap 21 can equalize through vent pipe 28. In other words, the pressure inside float switch 23 approaches the pressure inside suction trap 21, which is equal the suction pressure, $P_s$.

It is now noted that the pressure within discharge pipe 6 is equal to $P_d$, which is greater than the $P_s$. Therefore, refrigerant 1 will strive to flow from discharge pipe 6 to float switch 23, through vent pipe 30 and drainpipe 26. But as illustrated by the electrical wiring diagram, the normally-open electrical contact within float switch 23 is now open, which de-energizes and thus closes normally-closed solenoid valve 31. With solenoid valve 31 closed, flowage is prevented through vent pipe 30 from discharge pipe 6 to float switch 23. In addition, check valve 27 prevents flowage though drainpipe 26 from discharge pipe 6 to float switch 23. Thus, the pressure within float switch 23 is allowed to equal the pressure within suction trap 21.

Since the pressure within float switch 23 equals the pressure within suction trap 21, liquids can freely drain from suction trap 21 to float switch 23, through drain pipe 24 and check valve 25. Therefore, slugs that are captured by suction trap 21 are transferred to float switch 23. This process continues until the liquid level inside float switch 23 is sufficiently high enough to activate its double-throw electrical contacts. At this point, the mode of operation is shifted from step 1 to step 2.

Step Two—High liquid level inside float switch 23

As illustrated by the electrical wiring diagram, the normally-open electrical contact within float switch 23 is now closed, which energizes and thus opens normally-closed solenoid valve 31. With solenoid valve 31 open, the pressure between float switch 23 and discharge pipe 6 can equalize through vent pipe 30. In other words, the pressure inside float switch 23 approaches the pressure inside discharge pipe 6, which is equal the discharge pressure, $P_d$.

It is now noted that the pressure within suction trap 21 is equal to $P_s$, which is less than the $P_d$. Therefore, refrigerant 1 will strive to flow from float switch 23 to suction trap 21, through vent pipe 28 and drainpipe 24. But as illustrated by the electrical wiring diagram, the normally-closed electrical contact within float switch 23 is now open, which de-energizes and thus closes normally-closed solenoid valve 29. With solenoid valve 29 closed, flowage is prevented through vent pipe 28 from float switch 23 to suction trap 21. In addition, check valve 25 prevents flowage though drainpipe 24 from float switch 23 to suction trap 21. Thus, the pressure within float switch 23 is allowed to equal the pressure within discharge pipe 6.

Since the pressure within float switch 23 equals the pressure within discharge pipe 6, liquids can freely drain from float switch 23 to discharge pipe 6, through drainpipe 26 and check valve 27. Therefore, slugs that are stored in float switch 23 are transferred to discharge pipe 6. This process continues until the liquid level inside float switch 23 is sufficiently low enough to return its double-throw electrical contacts to the normal position. At this point, the mode of operation is shifted shift back to step 1 and the cycle is repeated.

Now, referring back to FIG. 1, the slugs that are injected into discharge pipe 6 can consist of both liquid refrigerant 1 and oil 4. Any liquid refrigerant within the slug is quickly converted to a vapor by the superheated refrigerant flow within discharge pipe 6 and then continues to travel as a vapor to again accomplish useful cooling. During the development of this invention, it has been verified that heat transfer between the superheated discharge flow and the injected liquid refrigerant occurs very quickly, presumably because of the direct contact between these two flow streams. Through experimentation, it has been determined that length of approximately 20 pipe diameters is required to fully vaporize the injected liquid refrigerant. This length, from the point of injection to oil separator 7, is marked on FIG. 1 as L.

After any liquid refrigerant has been vaporized, the slug is purely oil 4 and is entrained by refrigerant 1 within discharge pipe 6. The entrained oil 4 thus travels within discharge pipe 6 to oil separator 7. Upon entering oil separator 7, it is mostly captured from refrigerant 1. Captured oil 4 is first routed through oil pipe 8 to oil reservoir 9 for storage. From oil reservoir 9, the captured oil 4 is routed through oil pipe 12 to oil float valve 13 that allows oil 4 to properly flow into crankcase 3.

It should be understood that the preferred embodiment is merely illustrative of the present invention. Numerous variations in design and use of the present invention may be contemplated in view of the following claims without straying from the intended scope and field of the invention disclosed herein.

I claim:

1. A compressor protection device, said device comprising:

(a) A refrigeration system having a refrigerant, means for compressing said refrigerant, oil for lubricating said compressing means, means of condensing said refrigerant, means of evaporating said refrigerant;

(b) A discharge pipe for conveying said refrigerant from said compressing means to said condensing means;

(c) A liquid pipe for conveying said refrigerant from said condensing means to said evaporating means;

(d) A suction pipe for conveying said refrigerant from said evaporating means to said compressing means;

(e) A means for trapping liquid within said suction pipe of said refrigeration system;

(f) A means of injecting said trapped liquid into said discharge pipe of said refrigeration system.

2. The invention of claim 1, wherein said trapped liquid is said refrigerant.

3. The invention of claim 2, wherein said trapped liquid is said oil.

4. The invention of claim 3, wherein said trapped liquid is a mixture of said refrigerant and said oil.

5. The invention of claim 4, comprising:

(a) A means of capturing oil within said discharge pipe;

(b) Said oil capturing means located downstream of said injection point of said trapped liquid into said discharge pipe.

6. The invention of claim 5, comprising of a oil return means, for conveying said captured oil back to said compressing means.

7. The invention of claim 6, comprising of storage means for said captured oil.

8. The invention of claim 7, wherein said storage means is held at a pressure higher than the pressure of said oil within the said compressing means.

* * * * *